United States Patent [19]

Hayes

[11] Patent Number: 4,716,740

[45] Date of Patent: Jan. 5, 1988

[54] CONTROLLER APPARATUS AND METHOD FOR HEAT EXCHANGE SYSTEM

[76] Inventor: John H. Hayes, 560 N. Hart Blvd., Orlando, Fla. 32818

[21] Appl. No.: 851,516

[22] Filed: Apr. 14, 1986

[51] Int. Cl.[4] ..... F25B 39/04

[52] U.S. Cl. ..... 62/99; 62/184

[58] Field of Search ..... 165/22, 39; 62/175, 62/184, 180, 181, 183, 510, 99

[56] References Cited

U.S. PATENT DOCUMENTS

| | | | |
|---|---|---|---|
| 2,365,650 | 12/1944 | Shaw et al. | 62/184 X |
| 4,085,594 | 4/1978 | Mayer | 236/1 EA |
| 4,210,957 | 7/1980 | Spethmann | 62/175 X |
| 4,483,152 | 11/1984 | Bitondo | 62/175 |
| 4,533,080 | 8/1985 | Clark et al. | 165/22 X |
| 4,554,964 | 11/1985 | Awano et al. | 165/39 |

*Primary Examiner*—William E. Wayner

*Attorney, Agent, or Firm*—Duckworth, Allen, Dyer

[57] ABSTRACT

Controller apparatus and method for single or multiple heat exchange systems of the type including a working fluid circuit connected to each heat exchanger and with a working fluid in the circuit. In a multiple heat exchange system configuration, a manifold couples together all of the working fluid outputs or inputs from all of the heat exchangers for all of the systems, with an averaging relay for receiving inputs representative of the refrigerant head pressure for the condenser of each heat exchange system and for providing an output from the averaging relay representative of an average of the pressures for all of the systems. A control circuit, such as a pneumatic, electrical or electronic circuit, controls the rate of flow and/or the rate of heat exchange for the working fluid into or out of the manifold responsive to the output of the averaging relay in order to control all of the heat exchange systems dependent upon the average energy demand, to thereby reduce the overall energy requirements for all of the heat exchange systems. In a single heat exchange system configuration, the output rate of and/or the heat exchange characteristics of one heat exchanger (i.e., a cooling tower) is controlled by the refrigerant pressure characteristics.

17 Claims, 2 Drawing Figures

FIG. 1

CONTROLLER APPARATUS AND METHOD FOR HEAT EXCHANGE SYSTEM

BACKGROUND OF THE INVENTION

1. Field of the Invention

The present invention relates generally to heat exchange systems and in particular relates to apparatus and methods for controlling the rate of flow and/or the rate of heat exchange for single or multiple heat exchange systems in order to reduce the overall energy demand for all of the heat exchange systems.

2. Description of the Prior Art

A conventional heating or cooling installation for a building facility typically employs at least one heat exchange system, each system having a heat exchanger, a condenser (which is also a form of heat exchanger), a working fluid circuit between the heat exchanger and the condenser, and a working fluid in the circuit. For example, in a water-based system, the heat exchanger usually compriss a cooling tower or a deep well source of cool water, the cooled water serving as the working fluid and being delivered to the condenser by a pump. In a cooling tower system, a fan is utilized to blow across the water as it trickles down the cooling tower, in order to remove heat. In the condenser, the cooled water is used to exchange heat with a conventional refrigerant (such as freon), permitting the refrigerant to then be used for cooling purposes.

There is a need for efficiently controlling both single and multiple heat exchange systems to reduce the overall energy demand.

A number of prior art arrangements deal with multiple heat exchange systems working together. For example, in U.S. Pat. No. 3,167,113, Kleiss discloses techniques for equalizing loads on multiple heat exchangers. A somewhat similar arrangement is disclosed by Funk in U.S. Pat. No. 4,381,814.

Carson, in U.S. Pat. No. 4,197,868, discloses a control system for regulating the division of a single feed stream between two or more heat exchange units operating in parallel. In U.S. Pat. No. 4,474,169, Steutermann discloses a control arrangement for multiple solar heat collecting systems. Other prior art of interest is contained in U.S. Pat. No. 3,995,443 to Iversen and U.S. Pat. No. 4,168,030 to Timmerman. Other United States patents of interest are found in Class 165, Subclasses 1, 13, 22, 31, 34, 35, 38 and 40 in the search records of the United States Patent and Trademark Office.

SUMMARY OF THE INVENTION

The present invention is directed to controller apparatus and a related method for use in connection with single or multiple heat exchange systems.

In accordance with the present invention, a single heat exchange system having a heat exchanger and a condenser is provided with a controller for varying either the heat exchange characteristics of the working fluid from the heat exchanger or its flow rate, or both, responsive to the head pressure of refrigerant in the condenser. A system having multiple heat exchange systems and a working fluid circulating through the condenser of each system for heating or cooling purposes, is provided with a common source of working fluid to all of the condensers, and control means for supplying working fluid to that common source dependent upon an average of the energy demand upon all of the condensers. The controller means may also control the heat exchange characteristics of the working fluid from the common source dependent upon the average of the energy demands upon all the condensers, and also controls the flow of working fluid through each of the condensers dependent upon the energy demands upon another one or other ones of the condensers. Typically, the average of the energy demands upon all of the condensers is determined by measuring the head pressure or difference in head pressure and suction pressure of the associated refrigerant for each condenser and taking an average of those pressures for purposes of controlling the system, as outlined above. However, other energy demand characteristics may be utilized to determine the average demand on all of the condensers, without departing from the spirit and scope of this invention.

In one form of the present invention, the common source of working fluid comprises a manifold having multiple independent outputs of the working fluid connected thereto. The controller means may control either the flow rate into or out of the manifold, or the rate of heat exchange of the working fluid (or both), dependent upon the average of the energy demands upon all of the multiple independent outputs connected to the common source of working fluid. It will be understood by those skilled in the art that such an arrangement reduces the overall energy demand for all of the multiple heat exchange systems, while providing the necessary energy requirements for each system.

In the particular example where multiple cooling tower installations are utilized in connection with multiple condensers, the outputs of all of the cooling towers are coupled together in a manifold, the output of each cooling tower being fed into the common manifold by an associated pump. Likewise, each cooling tower has an associated fan for cooling the working fluid passing therethrough. The control means includes an averaging relay for receiving multiple inputs, each input representative of the refrigerant pressure or differential for one of the condensers, and for providing an output from that averaging relay representative of an average of the refrigerant pressures for all of the condensers. The control means then varies the speed of the pumps or fans, or both, responsive to that averaging relay output, to determine the amount of working fluid and its heat exchange characteristics, as it enters the common manifold. The amount of working fluid which is permitted to enter each condenser is then controlled by the energy demands on one or more of the other condensers. In one specific arrangement, normally open valves are provided on the inlet or outlet working fluid side of each condenser, which valves are either permitted to remain open or are partially or fully closed dependent upon the highest pressure on the remaining condensers. In this way, the rate of flow of working fluid through all of the condensers is balanced, while the amount of heat exchange fluid, and its heat exchange characteristics, are controlled by the average energy demand for all of the condensers, in the manner noted above. The system thus functions in its intended manner to significantly reduce the overall energy consumption of all of the heat exchange systems with respect to the total energy requirements for all of the heat exchange systems if each were operated independently and without the benefits of the controller arrangement controlled by this invention.

DETAILED DESCRIPTION OF THE PREFERRED EMBODIMENT

A preferred embodiment of the present invention as utilized in connection with a multiple cooling tower cooling installation will now be described with reference to FIGS. 1 and 2.

Figure 1:
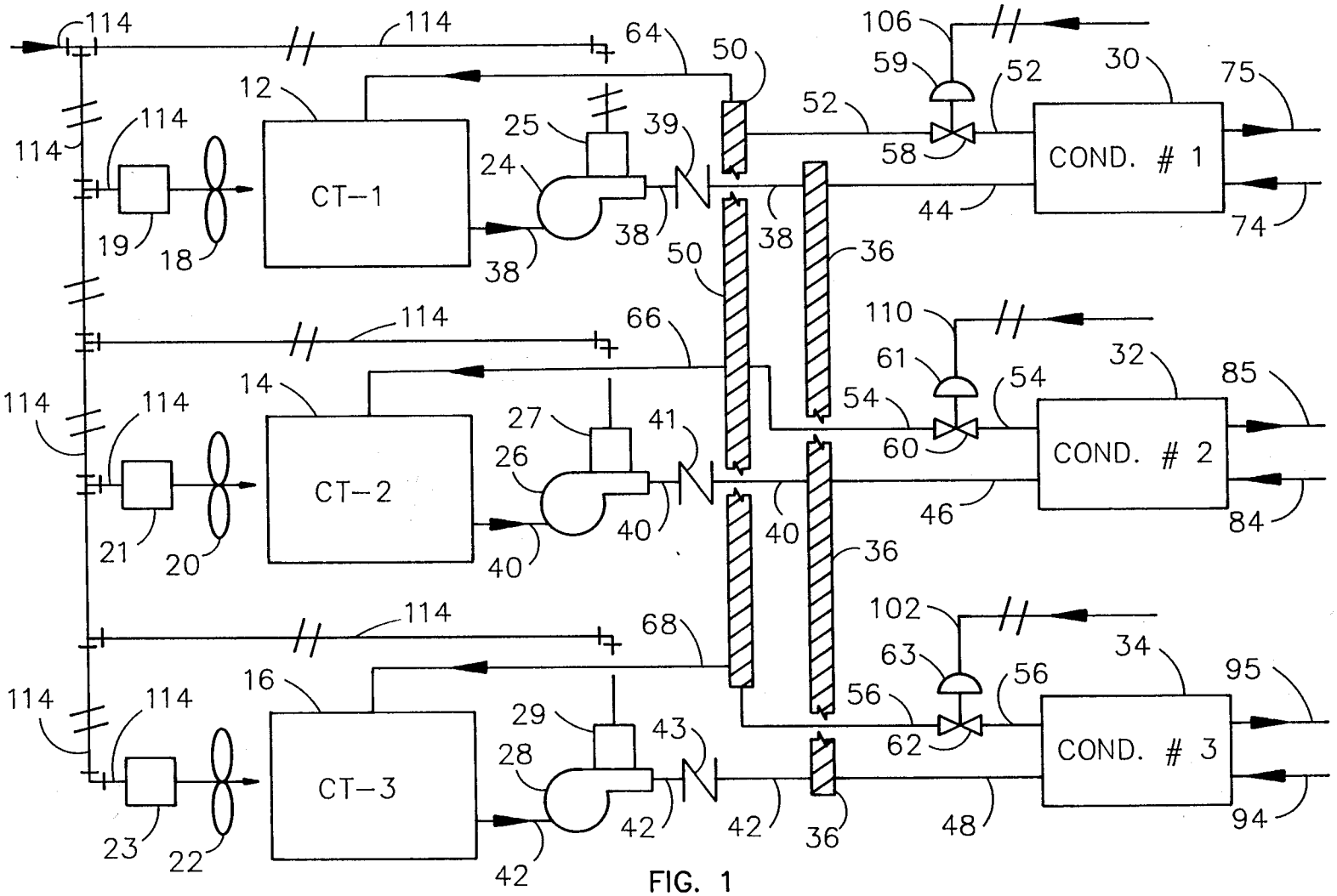
FIG. 1 illustrates schematically a heat exchange installation utilizing multiple heat exchange systems in accordance wtih the present invention, and which is utilized in connection with the controller illustrated in FIG. 2.

Referring first to FIG. 1, there is a typical multiple cooling tower water installation having three cooling towers 12, 14 and 16. Associated with each cooling tower is a respective fan 18, 20 and 22, each having a corresponding fan speed controller 19, 21 and 23. Pumps 24, 26 and 28 are associated with each corresponding cooling tower 12, 14 and 16, each pump having a corresponding pump speed controller 25, 27 and 29. Three condensers 30, 32 and 34 are provided.

Each condenser 30, 32 and 34 has a respective refrigerant input line 74, 84 and 94 and a refrigerant output line 75, 85 and 95. The cooling towers (12, 14 and 16), fans (18, 20 and 22), pumps (24, 26 and 28), condensers (30, 32 and 34) are all portions of conventional cooling tower systems.

In accordance with the present invention, there is provided a common manifold 36 connected via working fluid circuits 38, 40 and 42 to the outputs of all of the pumps 24, 26 and 28 to thereby provide a common supply of the working fluid outputs from the cooling towers 12, 14 and 16. Conventional check valves 39, 41 and 43 are positioned in the working fluid circuits 38, 40 and 42, respectively.

Further in accordance with the present invention, the installation is provided with multiple independent working fluid outputs 44, 46 and 48 from the common manifold 36, each of those outputs connected to a corresponding condenser 30, 32 and 34.

There is also provided in the modified installation of this invention an output manifold 50 coupled to each of the outputs of the condensers 30, 32 and 34 via working fluid output circuits 52, 54 and 56. Each output of the condenser 30, 32 and 34 passes through a normally open valve, correspondingly designated by reference elements 58, 60 and 62, respectively. The output manifold 50 feeds the input to all of the cooling towers 12, 14 and 16 via respective working fluid circuit lines 64, 66 and 68.

Each of the fan speed controllers 19, 21 and 23 and each of the pump speed controllers 25, 27 and 29 are coupled to a controller 70 (FIG. 2) by a control circuit line 114, the purpose of which is detailed below. Valves 58, 60 and 62 interposed in the working fluid circuit lines 52, 54 and 56 from condensers 30, 32 and 34 employ respective valve actuators 59, 61 and 63, each of which is coupled to the controller 70 of FIG. 2 by circuit lines 106, 110 and 102, respectively, as is shown on the extreme right hand portion of FIG. 1.

Figure 2:
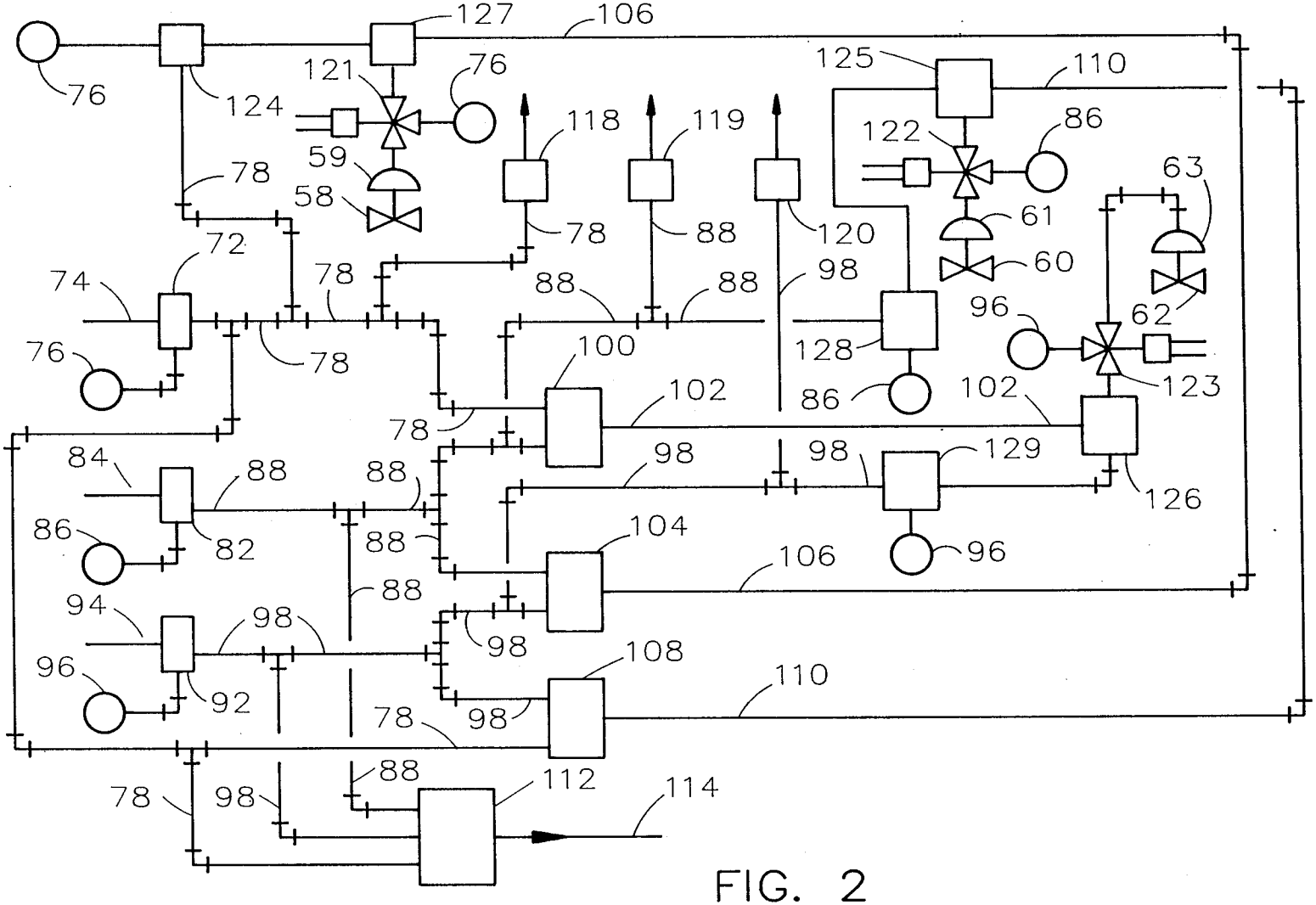
FIG. 2 illustrates a controller apparatus for the multiple heat exchange systems installation of FIG. 1 in accordance with the present invention, and in which the controller is coupled to the installation of FIG. 1 in a manner more fully described above.

Reference is now made to FIG. 2, where an embodiment of a controller circuit in accordance with the present invention is shown. While the controller 70 of FIG. 2 is described as a pneumatic apparatus, it will be understood that other forms of the controller may be utilized without departing from the scope of the present invention; for example, the controller may either be an electric, electronic or hydraulic system for purposes of providing the control features used in connection with the installation of FIG. 1, and which are more fully described below.

The controller 70 of FIG. 2 utilizes an arrangement of head pressure detectors, head pressure selectors and an averaging relay to provide outputs to the installation of FIG. 1 to control the speed of pumps 24, 26 and 28 and thus the rate of flow of working fluid into the common manifold 36; the speed of fans 18, 20 and 22 and thus the rate of heat exchange in the cooling towers 12, 14 and 16; and the position of the valves 58, 60 and 62 to thus control the amount of working fluid passing through each condenser 30, 32 and 34.

In order to accomplish the functions described above, the controller 70 of FIG. 2 is provided with three pneumatic pressure detectors 72, 82 and 92, each of which is coupled to the respective refrigerant input 74, 84 and 94 of the corresponding one of the condensers 30, 32 and 34 in order to measure head or differential pressure in the refrigerant circuit for each compressor associated with each condenser. Likewise, there is provided an main air pressure input 76, 86 and 96 to each of the detectors 72, 82 and 92 to provide a continuous source of air under pressure. Typically, the main air pressure is on the order of 20 p.s.i. A pneumatic control output line 78, 88 and 98 is respectively coupled to the detectors 72, 82 and 92, with each output 78, 88 and 98 providing control inputs, as is shown in FIG. 2, to three high pressure selectors 100, 104 and 108 and to averaging relay 112.

More specifically, pneumatic control output 78 provides an input to high pressure selectors 100 and 108, and a pressure indication input to the averaging relay 112. Pneumatic control output 88 provides inputs to high pressure selectors 100 and 104, and a pressure indication to averaging relay 112. Pneumatic control output 98 provides inputs to high pressure selectors 104 and 108, and to the averaging relay 112.

As this configured, high pressure selector 100 receives pressure indication inputs from detectors 72 and 82, and provides an output 102 representative of the highest of the head or differential pressure as between compressors associated with condensers 30 and 32. Likewise, high pressure selector 104 receives inputs from detectors 82 and 92 and provides an output 106 which indicates the highest of the head or differential pressures as between compressors associated with condensers 32 and 34. Finally, high pressure selector 108 receives inputs from detectors 72 and 92 and provides an output 110 indicative of the highest of head or differential pressures as between compressors associated with condensers 30 and 34. Averaging relay 112 receives inputs 78, 88 and 98 and provides an output 114 which represents the average of all of the head or differential pressures for all three compressors associated with condensers 30, 32 and 34. This output 114 thereby provides an indication of the average energy demand for all three compressors associated with condensers.

Referring again to FIG. 1, it is seen that the outputs 102, 106 and 110 are coupled to valve actuators 63, 59 and 61 which operate respective valves 62, 58 and 60. The average output 114 is coupled to the fan speed controllers 19, 21 and 23, and also to the pump speed controllers 25, 27 and 29.

A specific example of the manner in which the system of FIGS. 1 and 2 functions will now be described. A 4 to 10 pound variation in refrigerant head pressure at the input 74, 84 or 94 of the respective condenser 30, 32 or 34 is detected by detectors 72, 82 or 92 to provide a pressure indication to selectors 100, 104 and 108 as well as to the averaging relay 112. Such a 4 to 10 pound head pressure variation produces, typically, a 3 to 15 pound change in the branch air pressure of the pneumatic control outputs 78, 88 or 98 from the detectors 72, 82 and 92. The high pressure selectors 100, 104 and 108 transmit the highest pressure indicated by the detectors 72 or 82, 82 or 92 and 72 or 92, respectively. The output high pressure indications 102, 106 and 110 are used to operate the valve actuators 63, 59 and 61 from a normally open to a fully closed position, depending upon the high pressure indication. By way of example, a pressure from 15 to 17 pounds as an output from any of the selectors 100, 104 or 108 will result in the modulation of any of the valves 62, 58 or 60 respectively from the fully open to the fully closed position.

The outputs of detectors 72, 82 and 92 are averaged by the averaging relay 112, the output 114 of which varies the speed of the three cooling tower fans 18, 20 and 22 and the three pumps 24, 26 and 28 from zero rpm at about 3 pounds to full speed at about 15 pounds of control pressure resulting from condenser head pressure. If pumps 24, 26 and 28 are not operating at sufficient speed with the quality of the working fluid produced by the cooling towers 12, 14 and 16 at the reduced speed of the cooling tower fans 18, 20 and 22 to maintain a refrigerant head pressure of 10 pounds or less at any one of the condensers 30, 32 or 34, then the outputs 102, 106 and/or 110 will gradually close valves 62,58, and/or 60 to throttle the working fluid outputs of the any other condenser which is not experiencing a sufficient head pressure to result in an increase in speed of cooling tower fans 18, 20 and 22 and pumps 24, 26 and 28.

If the refrigerant head pressure at any one of the condensers 30, 32 or 34 exceeds 11 pounds, this pressure will produce an output pressure at controllers 72, 82 or 92 or 17 pounds or more which through outputs 78, 88 or 98 will activate controllers 118, 119 or 120 to reduce the capacity of the compressors associated with condensers 30, 32 and 34 to restrict the rise in head pressure.

If any one of the condensers 30, 32 or 34 is shut down for any reason controllers 121, 122 or 123 will switch from control air to main air to valve controllers 59, 61 or 63 to shut off the water to the inactive condenser 30, 32 or 34. If the refrigerant head pressure on any one of the condensers 30, 32 or 34 drops below 4 pounds, reversing relays 124, 125 or 126 through high pressure selectors 127, 128 or 129 will throttle the valves 58, 60 or 63 to raise the head pressure to a desired level. In a single heat exchange syustem, such as defined by cooling tower 12 and condenser 30 in FIG. 1, the refrigerant head or differential pressure from the condenser 30 may be used to either control the speed of pump 24 or fan 18, or both.

It will thus be appreciated by those skilled in the art that the system and controls of the present invention operates to reduce the overall energy demands of single or multiple heat exchange systems and to increase overall system efficiency.

I claim:

1. A controller for use with two or more heat exchange systems in which each system includes first and second heat exchangers, a working fluid circuit between the heat exchangers of each system and a working fluid in said circuit, said controller comprising:

(a) means manifolding together the outputs of said working fluid circuits for all of the first heat exchangers for all of the heat exchange systems and providing an input from said manifolding means to all of the second heat exchangers for all of the heat exchange systems; and (b) means for controlling the flow of said working fluid from each of the first heat exchangers dependent upon the average energy demand for all of the second heat exchangers.

2. The system recited in claim 1 further comprising means for controlling the flow of said working fluid through each of the second heat exchangers of the heat exchange system dependent upon the energy demand upon another of said second heat exchangers.

3. The system recited in claim 1 further comprising means for controlling the rate of heat exchange in each of the first heat exchangers dependent upon said average energy demand for all of the second heat exchangers.

4. The system recited in claim 1 further comprising means manifolding together the working fluid circuit outputs from all of the second heat exchangers.

5. The system recited in claim 4 further comprising means for controlling the flow of working fluid through each of the second heat exchanger.

6. The system recited in claim 5 wherein each said heat exchange system includes a pump for controlling the flow of said working fluid out of the first heat exchanger of each system and wherein said flow controlling means includes means for controlling each pump in each heat exchange system responsive to changes in the average energy demand of all of the second heat exchangers.

7. A multiple zone cooling system comprising:

(a) plural heat exchange systems, each including a heat exchanger, a condenser, and a working fluid circuit between said heat exchanger and said condenser with a working fluid in said circuit, each condenser having a refrigerant circulating therein and adapted to provide cooling to one of mutliple zones;

(b) a manifold coupling together all of the working fluid outputs from all of the heat exchangers for said plural heat exchange systems;

(c) plural pumps, each associated with one of said heat exchange systems for pumping the working fluid output of an associated one of said heat exchangers into said manifold;

(d) plural fans, each fan associated with one of said heat exchangers for cooling said working fluid passing therethrough;

(e) averaging means for receiving inputs representative of the pressure for refrigerant in each of said condensers and for providing an output from said averaging means representative of an average of refrigerant pressure for all of said condensers; and (f) means for controlling said pumps and said fans responsive to said average output from said averaging means to thereby reduce the overall energy requirements for all of said systems.

8. The system recited in claim 7 further comprising valve means coupled to the working fluid output of each of said condensers, and means for controlling said valve means for each condenser dependent upon the refrigerant pressure of others of said condensers.

9. The system recited in claim 8 further comprising another manifold for receiving the working fluid outputs of all of said condensers and providing an input therefrom to each of said heat exchangers.

10. The system recited in claim 9 wherein each said heat exchanger comprises a cooling tower.

11. A system for controlling energy usage for multiple heat exchanger installations, said system comprising:

(a) a working fluid manifold;

(b) plural input heat exchangers coupled to said manifold, each heat exchanger adapted to receive working fluid and perform a heat exchanger function to alter the heat exchanger characteristics of the working fluid;

(c) means for varying the output rate of flow of working fluid for each of said input heat exchangers;

(d) means for varying the heat exchange rate of working fluid for each of said input heat exchangers;

(e) plural output heat exchangers coupled to said manifold for receiving working fluid outputs therefrom, each output heat exchanger having a refrigerant circulating therein and adapted to utilize the heat exchange characteristics of the working fluid to perform a work function upon said refrigerant; and (f) means for controlling said rate of flow varying means and said heat exchange rate varying means dependent upon an average of the pressure characteristics for all of said output heat exchangers.

12. The system recited in claim 11 further comprising another manifold having an input for receiving working fluid outputs from all of said output heat exchanges and for providing a working fluid return to all of said first heat exchangers.

13. The system recited in claim 12 further comprising means for controlling the rate of working fluid flow through each of said output heat exchangers dependent upon the working fluid pressure at the output of others of said output heat exchangers.

14. A cooling installation comprising:

(a) a first cooling tower having an associated first fan and first pump for heat exchange purposes in order to provide a first working fluid output therefrom;

(b) means for varying the speed of said first cooling tower fan or pump, or both, for varying the heat exchange characteristics of said first working fluid output;

(c) a second cooling tower having an associated second fan and second pump for circulating a working fluid therethrough for heat exchange purposes in order to provide a second working fluid output therefrom;

(d) second means for varying the speed of said second cooling tower fan or pump or both, for varying the heat exchange characteristics of said second working fluid output;

(e) means for manifolding together the first and second working fluid outputs in order to provide a common source of working fluid, the heat exchange characteristics of which are determined by said first and second working fluid outputs;

(f) first and second condensers, each condenser having a refrigerant circulating therein and each condenser coupled to receive a working fluid input from said common source for heat exchange with said refrigerant in order to alter the heat exchange characteristics of said refrigerant; and (g) means for controlling said first and second fan and pump speed varying means dependent upon an average of the pressure characteristics of said refrigerant in all of said condensers.

15. The cooling installation recited in claim 14 further comprising:

(a) a working fluid return line from each condenser;

(b) a valve from each condenser;

(c) a valve in each working fluid line; and (d) means for operating each valve dependent upon the refrigerant pressure in the other condenser.

16. The cooling installation recited in claim 15 further comprising:

(a) means for manifolding together all of the working fluid return lines into a common return; and (b) means for supplying working fluid to each of said cooling towers from said common return.

17. A method for controlling a multiple zone cooling system of the type having plural heat exchange systems each including a heat exchanger, a condenser having a refrigerant circulating therein, and a working fluid circuit between said heat exchanger and said condenser with a working fluid in said circuit, and in which each condenser is adapted to utilize said refrigerant to provide cooling to one of multiple zones, said method comprising the steps of:

(a) manifolding together all of the working fluid outputs from all of the heat exchangers into a common supply and providing multiple independent outputs from said common supply of said working fluid to each of said condensers;

(b) providing an output representative of the average pressure characteristics of refrigerant for all of said condensers; and (c) controlling the pumping of working fluid into said common supply and the rate of heat exchange in said heat exchangers responsive to said average output, to thereby reduce the energy requirements for all of said systems.

* * * * *